US009612011B2

(12) United States Patent
Staley et al.

(10) Patent No.: US 9,612,011 B2
(45) Date of Patent: Apr. 4, 2017

(54) PREHEAT BURNER ASSEMBLY AND METHOD

(71) Applicant: Honda Motor Co., Ltd., Tokyo (JP)

(72) Inventors: Gregory L. Staley, Bluffton, OH (US); James R. Siegel, Fort Loramie, OH (US); Steve Schumann, Troy, OH (US)

(73) Assignee: Honda Motor Co., Ltd., Tokyo (JP)

( * ) Notice: Subject to any disclaimer, the term of this patent is extended or adjusted under 35 U.S.C. 154(b) by 830 days.

(21) Appl. No.: 14/011,847

(22) Filed: Aug. 28, 2013

(65) Prior Publication Data

US 2014/0065564 A1 Mar. 6, 2014

Related U.S. Application Data

(60) Provisional application No. 61/694,976, filed on Aug. 30, 2012.

(51) Int. Cl.

| | |
|---|---|
| ***F23D 14/28*** | (2006.01) |
| ***F23D 14/56*** | (2006.01) |
| ***F23D 14/46*** | (2006.01) |
| ***F23C 5/06*** | (2006.01) |
| ***F23D 23/00*** | (2006.01) |
| ***F23D 99/00*** | (2010.01) |

(52) U.S. Cl.

CPC ..... *F23D 14/28* (2013.01); *F23C 5/06* (2013.01); *F23D 14/46* (2013.01); *F23D 14/56* (2013.01); *F23D 23/00* (2013.01); *F23D 91/02* (2015.07)

(58) Field of Classification Search

CPC ..... F23D 14/28; F23D 14/46; F23D 91/02; F23D 23/00; F23C 5/06; F24D 14/56

USPC ..... 431/7, 101, 111, 202, 279; 248/240, 248/278.1, 279.1, 280.11; 212/299, 230; 126/39 E; 432/6, 62, 157, 214; 239/165, 239/169, 140, 149, 587.6

IPC ..... F23D 14/28,14/56, 14/46, 23/00; F23C 5/06

See application file for complete search history.

(56) References Cited

U.S. PATENT DOCUMENTS 157,644 A * 12/1874 Smith ..... F23D 14/28 431/343
591,239 A * 10/1897 McKone ..... F23D 91/02 126/231
620,692 A * 3/1899 Burns ..... F23D 14/28 137/616.7

(Continued)

FOREIGN PATENT DOCUMENTS

GB 2097902 A * 11/1982 ..... C22B 7/004
GB WO 2007080414 A1 * 7/2007 ..... E05D 11/0027

(Continued)

*Primary Examiner* — Gregory Huson
*Assistant Examiner* — Daniel E Namay
(74) *Attorney, Agent, or Firm* — Rankin, Hill & Clark LLP

(57) ABSTRACT

A preheat burner assembly and method for preheating forming dies includes a frame, a burner manifold and a link assembly. The burner manifold as a plurality of burner orifices for preheating the forming dies. The burner manifold is connected to a fuel source. The link assembly mounts the burner manifold to the frame for movement between a stowed position and a deployed position. The burner is moved via the link assembly to a deployed position for preheating the forming dies. The forming dies are preheated. The burner manifold is subsequently moved via the link assembly from the deployed position to an upright stowed position.

19 Claims, 7 Drawing Sheets

(56) References Cited

U.S. PATENT DOCUMENTS

| | | | | | |
|---|---|---|---|---|---|
| 724,434 | A * | 4/1903 | Cavanagh | F23D 14/28 | 431/343 |
| 2,094,656 | A * | 10/1937 | Holt | F21V 21/26 | 248/278.1 |
| 2,781,832 | A * | 2/1957 | O'Connor | C03B 23/043 | 239/273 |
| 3,523,336 | A | 8/1970 | Kimber | | |
| 3,565,372 | A | 2/1971 | Jones et al. | | |
| 3,711,047 | A | 1/1973 | O'Leary | | |
| 3,982,715 | A | 9/1976 | Lindgren et al. | | |
| 4,263,753 | A * | 4/1981 | Imahashi | B24B 9/16 | 451/389 |
| 4,266,819 | A * | 5/1981 | Pemberton | B66F 9/18 | 294/104 |
| 5,044,327 | A * | 9/1991 | Hunt | F23C 5/02 | 110/182.5 |
| 5,243,927 | A | 9/1993 | Messik | | |
| 5,392,494 | A * | 2/1995 | Wronski | E05D 7/1055 | 16/270 |
| 5,711,052 | A * | 1/1998 | Delaske | E05D 15/30 | 16/245 |
| 7,487,943 | B1 * | 2/2009 | Gillespie | F16M 11/04 | 248/279.1 |
| 8,245,990 | B2 * | 8/2012 | Huang | F16M 11/04 | 248/276.1 |
| 2004/0055113 | A1 * | 3/2004 | Tremblay | E05D 7/04 | 16/319 |
| 2004/0070100 | A1 * | 4/2004 | Strobel | B26F 1/26 | 264/80 |
| 2005/0073070 | A1 * | 4/2005 | Getschel | B29C 59/08 | 264/154 |
| 2006/0186296 | A1 * | 8/2006 | Garceau | A47F 7/00 | 248/309.1 |
| 2007/0050947 | A1 * | 3/2007 | Moore | E05D 15/30 | 16/371 |
| 2007/0102131 | A1 | 5/2007 | Raffle | | |
| 2008/0006751 | A1 * | 1/2008 | Chen | F16M 11/10 | 248/278.1 |
| 2008/0153682 | A1 * | 6/2008 | Chen | A63B 23/12 | 482/136 |
| 2009/0173860 | A1 * | 7/2009 | Remy | F16M 11/04 | 248/278.1 |
| 2014/0065564 | A1 * | 3/2014 | Staley | F23D 14/28 | 432/88 |

FOREIGN PATENT DOCUMENTS

| | | | |
|---|---|---|---|
| JP | 2160159 | | 6/1990 |
| JP | 5212525 | | 8/1993 |
| JP | 09028549 | A * | 2/1997 |
| JP | 2008121340 | A * | 5/2008 |

* cited by examiner

PREHEAT BURNER ASSEMBLY AND METHOD

This application claims the benefit of U.S. provisional patent application Ser. No. 61/694,976, filed Aug. 30, 2012, which is incorporated by reference in its entirety herein.

BACKGROUND

The subject disclosure generally relates to a preheat burner assembly, and particularly relates to a preheat burner assembly for preheating forming dies that can be adapted to be onboard a die casting machine or assembly.

One known preheat burner assembly uses natural gas fired burners mounted to external carts. The external carts are manually positioned in place adjacent or between a set of casting dies to preheat the casting dies. By way of example, the casting dies may need to preheated prior to beginning to invest aluminum in the dies. Specifically, the casting dies may need to be preheated whenever there is a large time gap between use of the casting dies (e.g., over a weekend, after die changes, after long downtime, etc.). Manually positioning the die preheat burner carts takes both time and effort.

SUMMARY

According to one aspect, a preheat burner assembly for preheating forming dies includes a frame, a burner manifold and a link assembly. The burner manifold as a plurality of burner orifices for preheating the forming dies. The burner manifold is connected to a fuel source. The link assembly mounts the burner manifold to the frame for movement between a stowed position and a deployed position.

According to another aspect, a preheat burner assembly includes a mounting frame for attaching to a die casting machine frame and a link assembly movably mounting a burner to the mounting frame. The link assembly is movable between a stowed position wherein the burner is retracted from a forming die and a deployed position wherein the burner is extended adjacent the forming die for heating thereof.

According to a further aspect, a preheat burner method includes: providing a frame, a burner manifold for preheating forming dies and a link assembly movably mounting the burner manifold to the frame; moving the burner manifold via the link assembly to a deployed position for preheating the forming dies; preheating the forming dies; and moving the burner manifold via the link assembly from the deployed position to an upright stowed position.

DETAILED DESCRIPTION

Figure 1:
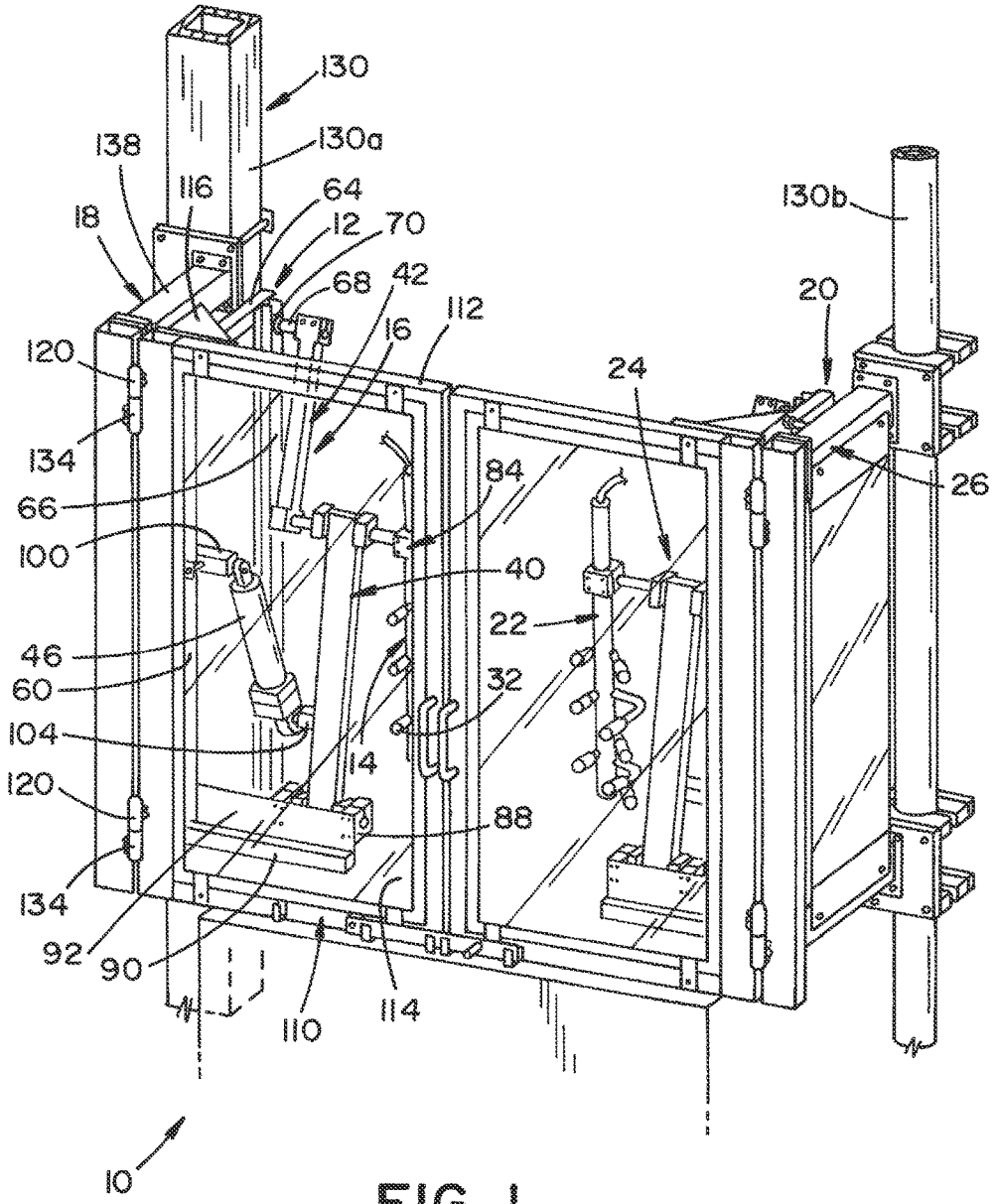
FIG. 1 is a perspective view of a preheat burner assembly having a pair of link frame subcomponents and mounting frame subcomponents mounted onboard a die casting machine frame.

Referring now to the drawings, wherein the showings are for purposes of illustrating one or more exemplary embodiments and not for purposes of limiting same, FIG. 1 illustrates a preheat burner assembly according to one exemplary embodiment generally designated by reference 10. The preheat burner assembly 10 of FIG. 1 includes a frame or frame assembly. In the particular embodiment illustrated, the frame is or includes a first link frame subcomponent 12, a burner manifold 14 and a link assembly 16 mounting the burner manifold 14 to the frame 12 for movement between a stowed position and a deployed position, as will be described in more detail below. The frame or frame assembly of the illustrated preheat burner assembly 10 additionally includes a first mounting frame subcomponent 18 to which the link frame subcomponent 12 is mounted.

Still further, the frame or frame assembly of the illustrated preheat burner assembly 10 additionally includes another link frame subcomponent 20, a second burner manifold 22 associated with the link frame subcomponent 20, a second link assembly 24 mounting the second burner manifold 22 to the second link frame subcomponent 20 for movement between a stowed position and a deployed position, and a mounting frame subcomponent 26 to which the link frame subcomponent 20 is mounted. Thus, the link frame subcomponent 12 is a first link frame subcomponent its associated mounting frame subcomponent 18 is a first mounting frame subcomponent. Likewise, the link frame subcomponent 20 is a second link frame subcomponent its mounting frame subcomponent 26 is a second mounting frame subcomponent.

Figure 2:
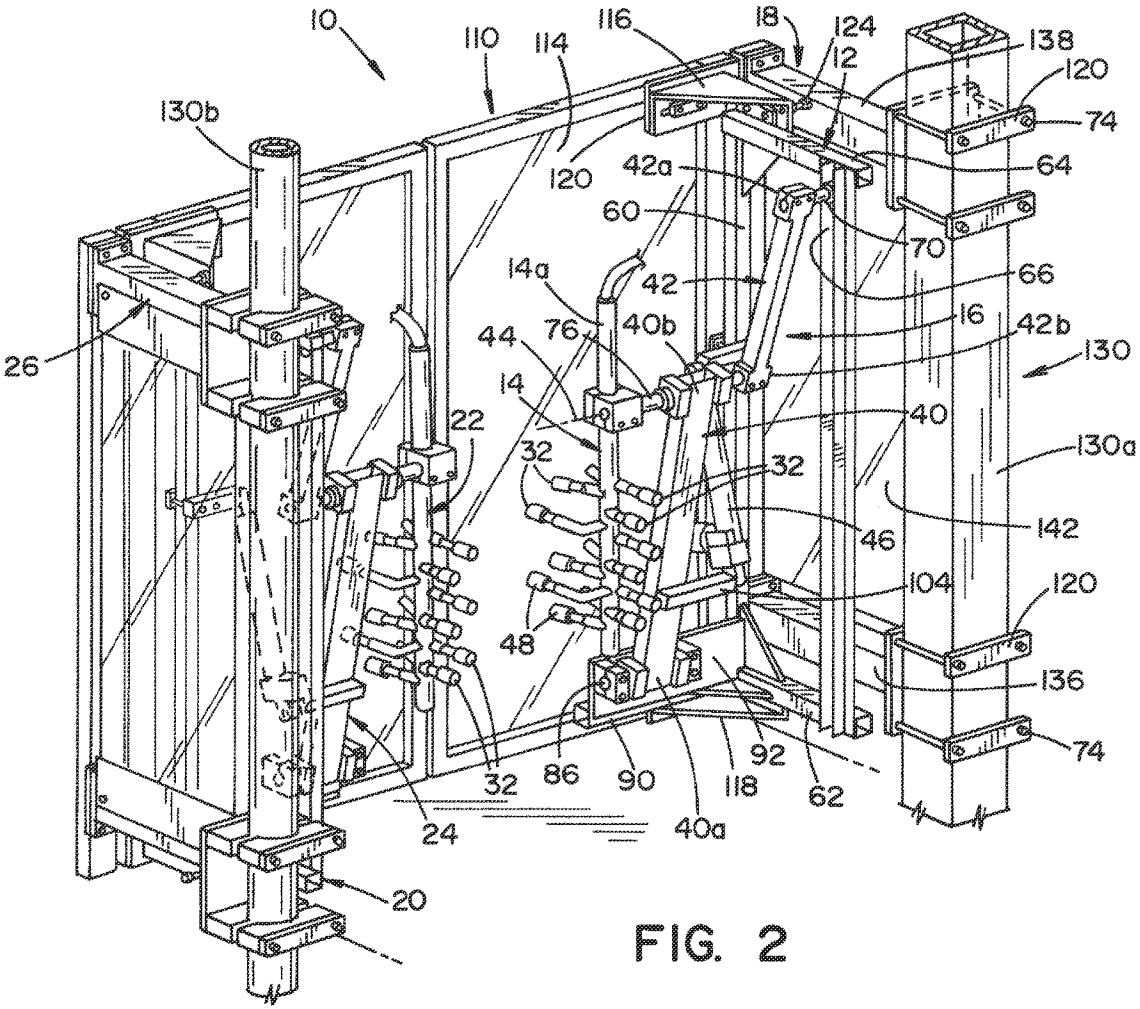
FIG. 2 is another perspective view of the preheat burner assembly of FIG. 1 shown from a rear side.

As shown in the illustrated embodiment, and with additional reference to FIG. 2, the second link frame subcomponent 20 can have a mirrored orientation relative to the first link frame subcomponent 12. Likewise, the second mounting frame subcomponent 24 can have a mirrored orientation relative to the first mounting frame subcomponent 18. Accordingly, and for brevity, only the first link frame subcomponent 12 and first mounting frame subcomponent 18, and their associated parts, will be described in further detail herein but is to be appreciated that all details concerning the first link frame subcomponent 12 and the first mounting frame subcomponent 18 are applicable to the second link frame subcomponent 20 and the second mounting frame subcomponent 24 unless indicated otherwise herein.

Figure 4:
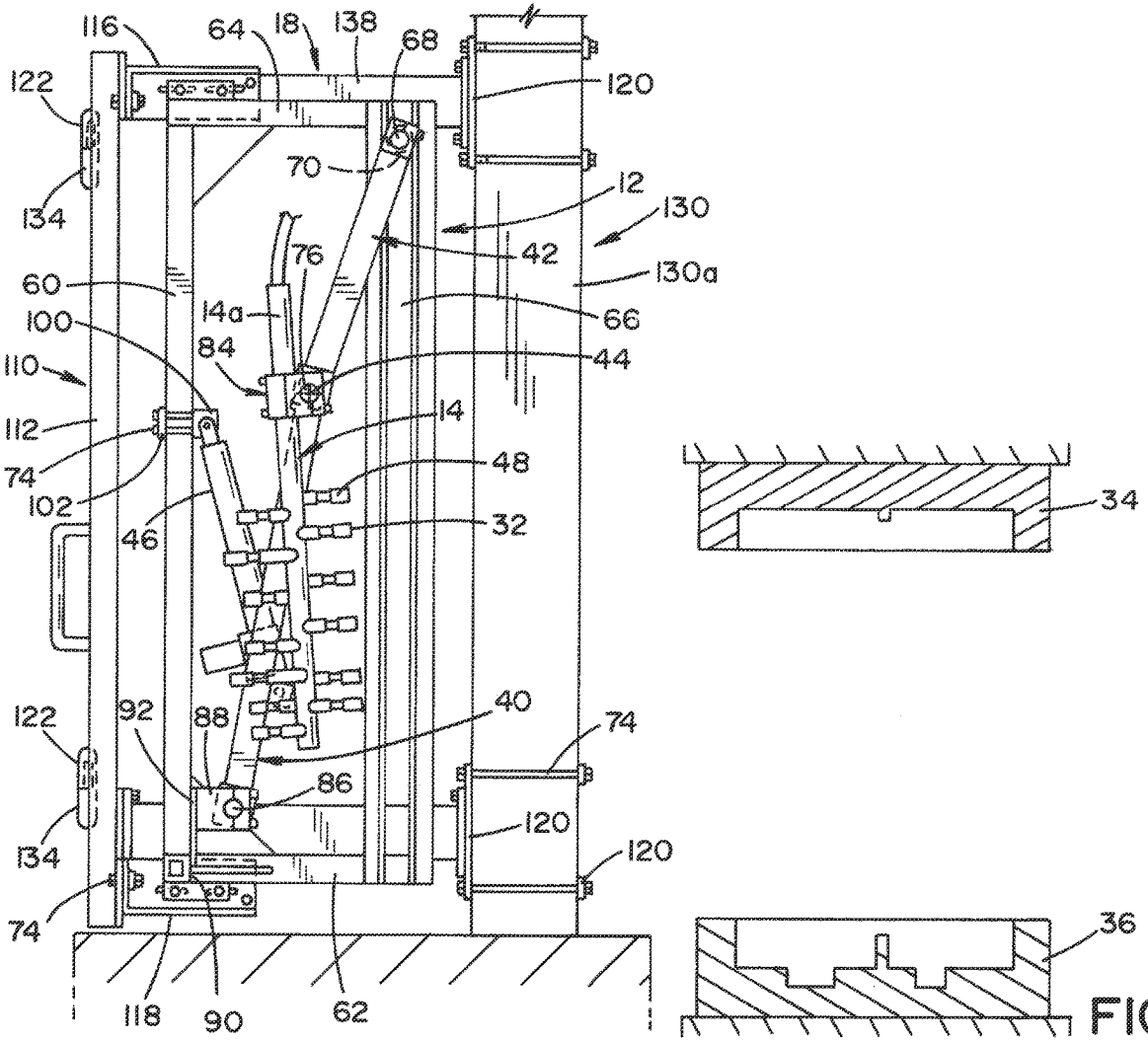
FIG. 4 is a side elevational view, partially in cross-section, of the preheat burner assembly showing one mounting frame subcomponent and one link frame subcomponent with a burner manifold in a stowed position.
Figure 5:
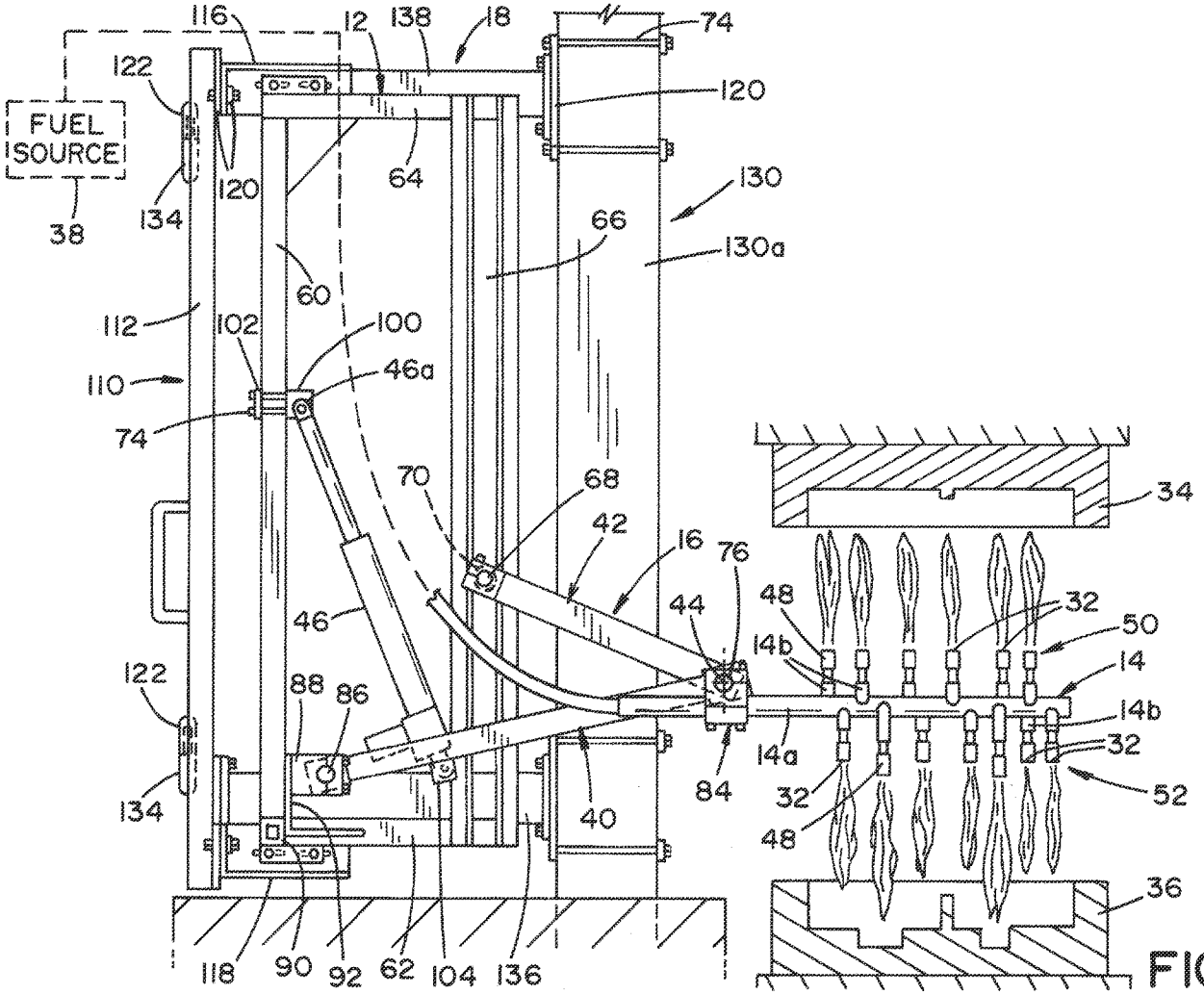
FIG. 5 is another side elevational view similar to FIG. 4 but showing the burner manifold in a deployed position between a set of forming dies.

The burner manifold 14 can have a plurality of burner orifices 32 for preheating forming dies, such as forming dies 34, 36 shown in FIGS. 4 and 5. As is known and understood by those skilled in the art (and schematically illustrated in FIG. 5), the burner manifold 14 can be connected to a fuel source 38, such as a natural gas fuel source for example. As already mentioned, the link assembly 16 mounts the burner manifold 14 to the frame or first link frame subcomponent 12 for movement between a stowed position and a deployed position. This enables the burner manifold 14 to be selectively positioned between the forming dies 34, 36 (i.e., in the deployed position) for preheating of the forming dies 34, 36 and selectively removed from the forming dies (i.e., in the stowed position) and moved out of the way during operation of the forming dies (e.g., during casting with the forming dies).

Figure 7:
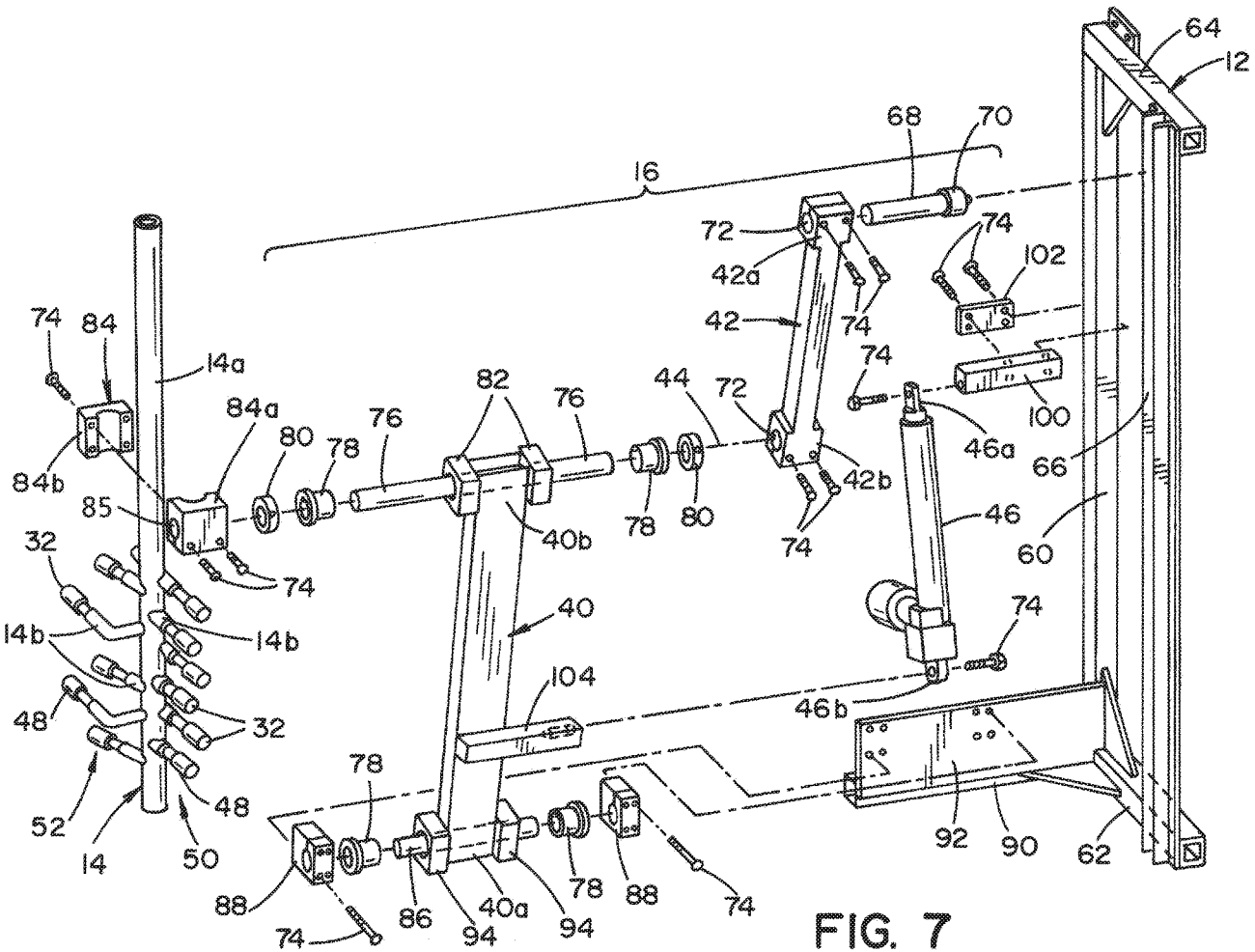
FIG. 7 is an exploded perspective view of one of the link frame subcomponents (e.g., the one mounted to the door and mounting frame subcomponent of FIG. 6).

With further reference to FIG. 7, in the illustrated embodiment, the link assembly 16 includes a first arm 40 having a first end 40*a* pivotally connected to the frame or first link frame subcomponent 12 and a second end 40*b* pivotally connected to the burner manifold 14. The link assembly 16 further includes a second arm 42 having a first end 42*a* pivotally and slidably connected to the frame or link frame subcomponent 12 and a second end 42*b* pivotally connected to the burner manifold 14. In particular, in the illustrated embodiment, the second ends 40*b*, 42*b* of the first and second arms 40, 42 pivotally connect to the burner manifold 14 at or along a common rotational axis 44.

As shown, an actuator 46 can be provided for powered movement of the burner manifold 14 via the link assembly 16 between the stowed position (shown in FIGS. 1-4) and the deployed position (shown in FIG. 5). The actuator 46 of the illustrated embodiment has a first end 46*a* pivotally connected to the frame or first link subcomponent 12 and a second end 46*b* pivotally connected to the first arm 40 at a location between and spaced apart from the first and second ends 40*a*, 40*b* of the first arm 40. Also particular to the illustrated embodiment, and as described in more detail below, the actuator 46 can be a telescoping cylinder actuator that moves between an extended position (shown in FIG. 5) wherein the actuator 46 pivots the first arm 40 downward (clockwise in FIGS. 4 and 5) to move the burner manifold 14 to the deployed position and a retracted position (shown in FIGS. 1-4) wherein the actuator 46 pivots the first arm 40 upward (counterclockwise in FIGS. 4 and 5) to the stowed position. By way of example, the actuator 46 can be any type of actuator (e.g., electric, hydraulic, pneumatic, etc.) and can be associated with a control device or panel on which one or more buttons are provided to provide push-button operation of the actuator 46. Accordingly, an operator need only press a button to move the burner manifold 14 from the stowed position to the deployed position and vice versa. More generally, the link assembly 16 is configured to rotate the burner manifold 14 downwardly and move the burner manifold 14 outwardly when moving the burner manifold 14 from the stowed position (shown in FIG. 4) to the deployed position (shown in FIG. 5) and operate in reverse when moving the burner manifold 14 from the deployed position back to the stowed position.

The burner manifold 14 of the illustrated embodiment includes a main manifold portion 14*a* and a plurality of directing conduit portions 14*b* extending orthogonally relative to the main manifold portion 14*a*. The plurality of orifices 32 can each be respectively disposed at distal ends of the directing conduit portions 14*b*, or more particularly, associated with a burner portion 48 extending from each of the directing conduit portions 14*b* of the burner manifold 14. The manifold 14 of the illustrated embodiment is particularly configured to heat of pair of opposed forming dies, such as upward or first forming die 34 and lower or second forming die 36 shown in FIGS. 4 and 5. In this regard, the plurality of directing conduit portions 14*b* can be organized into a first set 50 if directing conduit portions extending in a first direction (e.g., upward when in the deployed position) and a second set 52 of directing conduit portions extending in a second, opposite direction (e.g., downward when in the deployed position) for respectively heating the first and second forming dies 34, 36.

In the illustrated embodiment, the first link framing subcomponent or frame 12 includes a vertical member 60, lower and upper arm members 62, 64 spaced apart from one another and each extended orthogonally from the vertical member 60, and a track 66 spaced apart from the vertical member 60 and extending between the lower and upper arm members 62, 64 for slidably connecting to the link assembly 16, and particularly the second arm 42. Specifically, in the illustrated embodiment, the first end 42*a* of the second arm 42 is slidably connected to the frame or link frame subcomponent 12 along the track 66, which has a longitudinal length that is vertically oriented. More specifically, in the illustrated embodiment, the second arm 42, and particular the first end 42*a* thereof, is slidably connected to the track 66 by a guide pin 68 having a roller 70 received in the track 66. An end of the guide pin opposite the guide roller 70 is received in an aperture 72 of the first end 42*a*.

In particular, the first end 42*a* can be configured as the clamp having suitable fasteners 74 and thereby the first end 42*a* can be secured to the guide pin 68 and through the guide pin 68 to the track 66. The second end 42*b* of the second arm 42 can be similarly secured onto an axle 76 provided at the second end 40*b* of the first arm 40. In particular, the second end 42*b* can be configured as a clamp and suitable fasteners 74 can secure the second end 42*b* to the axle 76. As shown, a bearing member 78 and clamp ring 80 can be axially interposed between the second end 42*b* of the second arm 42 and a block member 82 disposed along the axle 76 of the first arm 40. Suitable fasteners can include bolts (as shown in the illustrated embodiment), rivets, etc, and generally can be any type of known fastener.

A clamping block 84 having first and second clamping members 84*a*, 84*b* can be secured via more suitable fasteners 74 to the burner manifold 14, particularly the main manifold portion 14*a*. The member 84*a* can have an aperture 85 therethrough for receiving the axle 76 thereby securing the burner manifold 14 to the first arm 40, and, since the second arm 42 is rotatably connected to the first arm 40 along the axle 76, the second arm 42 is also secured rotatably to the burner manifold 14. Like the connection between the second end 42*b* of the second arm 42 and the first arm 40, the connection between the burner manifold 14 and the first arm 40 can include bearing member 78, clamp ring 80 and block member 82.

The first end 40*a* can include an axle 86 that is rotatably connected via clamping blocks 88 to a projecting arm or member 90. More particularly, the arm 90 can extend orthogonally relative to the vertical member 60 and the lower arm 62. A plate member 92 can extend along with the arm 90 to which the blocks 88 are secured via suitable fasteners 74. The clamping blocks 88 thus rotatably connect to the axle 86 at the first end 40*a* of the first arm 40 for rotatably securing the first arm 40, and particularly the first end 40*a* thereof, to the link frame subcomponent 12. The plate member 92 can increase rigidity of the connection between the arm 40 and the link frame subcomponent 12 and/or can provide a convenient structure for securing the clamping blocks 88. More bearing members 78 can be axially interposed between the clamping blocks 88 and spacing blocks 94 at the first end 40*a*.

The first end 46*a* of the actuator 46 can be rotatably secured to the frame or link frame subcomponent 12. More particularly, in the illustrated embodiment, the first end 46*a* is secured to a block member 100 rotatably via suitable fastener 74 and block member 100 is secured to the vertical member 60 together with plate 102 through the use of further suitable fasteners 74. As shown, the first end 46*a* is rotatably connected to the vertical member 60 at a location spaced apart from and between the arms 62, 64. The lower end 46*b* is rotatably secured to a projecting arm or member 104 on the first arm 40. In particular, the member 104 is disposed on the arm 40 between and spaced apart from the ends 40*a*, 40*b* and provides a structure to which the second end 46*b* of the actuator 46 can be rotatably connected to the arm 40 via a suitable fastener 74.

Figure 3:
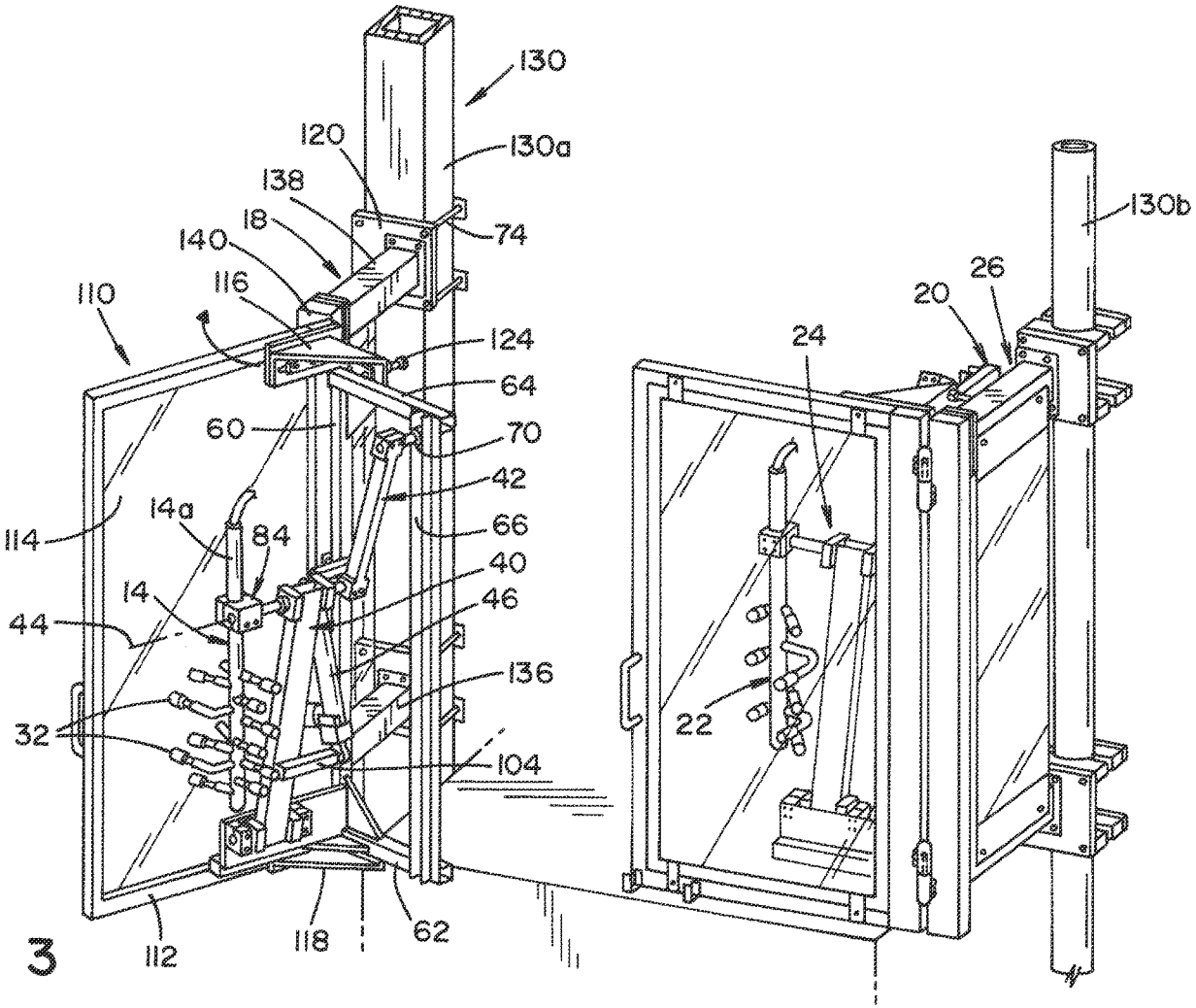
FIG. 3 is another perspective view of the preheat burner assembly similar to claim 1 but shown with the link frame subcomponent pivoted to an open door position.

As shown in the illustrated embodiment, particularly in FIGS. 1-3, a protective door 110 extends orthogonally from the vertical member 60 and orthogonal relative to the lower and upper arms 62, 64 of the frame or link frame subcomponent 12. Also as shown in the illustrated embodiment, and with reference to FIG. 6, the protective door 110 includes a rectangular frame 112 to which a barrier member 114 is secured to cover an open portion of the rectangular frame 112. The frame or link frame subcomponent 12, with the link assembly 16 and burner assembly 14 movably secured thereto, is secured to the door 110. In particular, corner brackets 116, 118 are used to secure the link frame subcomponent or frame 12 to the protective door 110, and particularly to the frame 112. As shown, the brackets can include slotted apertures that permit adjustment of the relative position of the link frame assembly 12 relative to the mounting frame subcomponent 18 and thus the machine frame 130.

In the illustrated embodiment, barrier member 114 is a heat-resistant transparent member, though it is to be appreciated that other suitable barrier materials could be used (e.g., fencing, metal mesh, etc.). Suitable fasteners 74 and plate members 120 are used to secure the frame or link frame subcomponent 12 to the frame 112 of the protective door 110. Likewise, more suitable fasteners 74 and plate or plate portions 120 can be used to secure the barrier member 114 to the frame 112. The frame 112 can be include a suitable hinge or hinge portion 122 for rotatably connecting the protective door 110 and the frame or link frame subcomponent 12 as described herein below. Also as shown, door stops 124 can be provided on the corner brackets 116, 118 for limiting pivotal movement of the protective door 110.

Figure 6:
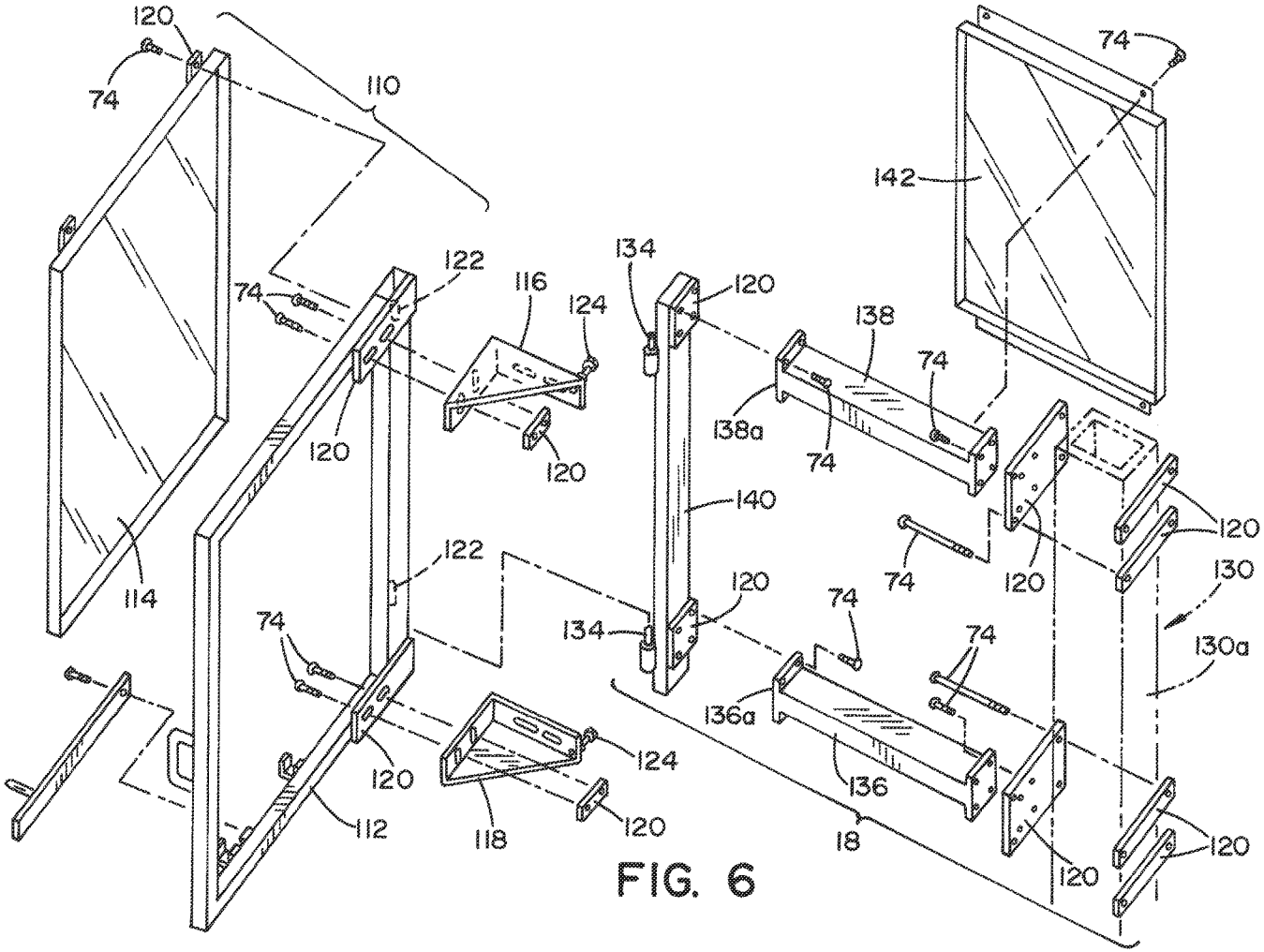
FIG. 6 is an exploded perspective view of one of the mounting frame subcomponents and a door for pivotally mounting the link frame subcomponent to the mounting frame.

With continued reference to FIG. 6, the mounting frame subcomponent 18 is illustrated in exploded detail. The mounting frame subcomponent 18 can be onboard mounted to a die casting machine frame 130 to which the forming dies 34, 36 are mounted. Thus, the mounting frame subcomponent 18 and all components mounted thereto (e.g., the protective door 110 and the link frame assembly 12) are conveniently mounted to the frame 130 and need not be separately moved into position and/or stored. As is known and understood by those skilled in the art, at least one of the forming dies (e.g., upper forming die 34) can be movably mounted to the die casting machine frame 130. The frame or link frame subcomponent 12 is mounted to the mounting frame subcomponent 18 thereby mounting the burning manifold 14 and a link assembly 16 to the die casting machine frame 130. In particular, the frame or link frame subcomponent 12 can be rotatably connected to the mounting frame subcomponent 18 along a vertical axis defined by the hinge portions 122 on the frame 112 and corresponding hinge portions or members 134 on the mounting frame subcomponent 18.

In the illustrated embodiment, the mounting frame subcomponent 18 includes a lower arm 136 and an upper arm 138. The lower arm 136 and the upper arm 138 are spaced apart from one another vertically and each extends orthogonally from a structural post 130*a* of the die casting machine frame in a first direction (e.g., to the left in FIGS. 4 and 5). The mounting frame subcomponent 18 further includes a vertical member 140 connected to and extending between distal ends 136*a*, 138*a* of the lower and upper arms 136, 138. A protective cover or barrier 142, which can be similar to the protective barrier 114, is secured to the lower arm 136, the upper arm 138 and the vertical member 140. Similar to the protective door 110, suitable fasteners 74 and plate members 120 can facilitate mounting of the arms 136, 138 to the frame 130, particularly to the structural post 130*a* thereof and between the vertical member 140 and the arms 136, 138. The hinge members 134 on the mounting frame subcomponent 18 can be particularly disposed on the vertical member 140 such that the protective door 110 can be pivotally mounted to the vertical member 140 of the mounting frame subcomponent 18.

As best shown in FIG. 3, the protective door 110 with the frame or link frame subcomponent 12 mounted thereto (and with the burner manifold 14 and link assembly 16 secured to the link frame subcomponent 12) can be pivotally opened relative to the mounting frame subcomponent 18 and the machine frame 130 to provide access to the dies 34, 36. As already mentioned, the second link frame subcomponent 20 and the second mounting frame subcomponent 24 can be the same or similar to the first link frame subcomponent 12 and the first mounting frame subcomponent 18, respectively, though arranged in mirrored fashion relative thereto. Accordingly, in best shown in FIGS. 1 and 2, the protective doors 110 of the first and second link frame subcomponents 12, 20 can together form a barrier when closed extending from respective vertical members 130*a*, 130*b* of the machine frame 130, and likewise extending from respective vertical members 60 and 140 of the first and second frame subcomponents 12, 18, 20, 24.

As mentioned, advantages of the preheat burner assembly 10 include the onboard arrangement of the burners relative to a die casting machine. This allows for automated movement of the burners between deployed and retracted/stowed positions and eliminates the need for manual effort to move a burner cart into and out of heating position relative to the dies. Further, the onboard arrangement provides for convenient, protected and out of the way storage for the burners. Still further, the barriers around the burners increase safety and reduce the likelihood of inadvertent contact with burners and associated heated components when still hot.

With references to FIGS. 4 and 5, a preheat burner method will now be described. In the method, a frame 12, a burner manifold 14 for preheating forming dies 34, 36 and a link assembly 16 movably mounting the burner manifold 14 to the frame 12 can be provided as already described herein. In the stowed position illustrated in FIG. 4, the link assembly 16 maintains the burner manifold 14 in a generally upright stowed position in which the burner manifold 14 is retracted from the forming dies 34, 36. When desired, an operator can press a pushbutton associated with the actuator 46 to move the burner manifold 14 via the link assembly 16 to the deployed position shown in FIG. 5 for preheating the forming dies 34, 36. As already mentioned above, the link assembly 16 is configured such that telescoping movement by the actuator 46 causes the burner manifold 14 to rotate downwardly (clockwise from FIG. 4 to the position illustrated in FIG. 5) and simultaneously move the burner manifold 14 outwardly into a position between the forming dies 34, 36 as the burner manifold 14 moves from the stowed position shown in FIG. 4 to the deployed position shown in FIG. 5.

Next, the forming dies 34, 36 can be preheated with the burner manifold 14 as is known and understood by those skilled in the art. When preheating of the forming dies 34, 36 is complete, the burner manifold 14 can be moved via the link assembly 16 from the deployed position of FIG. 5 to the upright stowed position of FIG. 4. This can occur by an operator pushing a pushbutton associated with the actuator 46 to cause the actuator to move from the extended position to a retracted position.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A preheat burner assembly for preheating forming dies, comprising:

a frame;

a burner manifold having a plurality of burner orifices for preheating the forming dies, the burner manifold connected to a fuel source; and a link assembly comprising at least a first arm that includes a first end pivotally connected to the frame and a second end pivotally connected to the burner manifold; and an actuator including a first end pivotally connected to the frame and a second end pivotally connected to the first arm, the actuator moves between a first position wherein the first arm is extended outward from the frame and the burner manifold is extended outward from the first arm to a deployed position and a second position wherein the first arm is retracted toward the frame and the burner manifold is retracted toward the first arm to a stowed position.

2. The preheat burner assembly of claim 1 wherein the actuator is for powered movement of the burner manifold between the stowed position and the deployed position.

3. The preheat burner assembly of claim 1 wherein the link assembly further comprises:

a second arm having a first end pivotally and slidably connected to the frame and a second end pivotally connected to the burner manifold.

4. The preheat burner assembly of claim 3 wherein the second ends of the first and second arms pivotally connect to the burner manifold along a common rotational axis.

5. The preheat burner assembly of claim 3 wherein the first end of the second arm is slidably connected to the frame along a track having a longitudinal length that is vertically oriented.

6. The preheat burner assembly of claim 3 wherein the second end of the actuator is pivotally connected to the first arm at a location between and spaced apart from the first and second ends of the first arm.

7. The preheat burner assembly of claim 6 wherein the actuator is a telescoping cylinder actuator that is extended in the first position to pivot the first arm downward to move the burner manifold to the deployed position and is retracted in the second position to pivot the first arm upward to the stowed position.

8. The preheat burner assembly of claim 1 wherein the link assembly is configured to rotate the burner manifold downwardly and move the burner manifold outwardly when moving the burner manifold from the stowed position to the deployed position.

9. The preheat burner assembly of claim 1 the burner manifold includes a main manifold portion and a plurality of directing conduit portions extending orthogonally relative to the main manifold portion, the plurality of orifices respectively disposed at distal ends of the directing conduit portions, the plurality of directing conduit portions including a first set of directing conduit portions extending in a first direction and a second set of directing conduit portions extending in a second, opposite direction for respectively heating first and second members of the forming dies.

10. The preheat burner assembly of claim 1 wherein the frame is a link frame subcomponent and the preheat burner assembly further includes:

a mounting frame subcomponent onboard mounted to a die casting machine frame to which the forming dies are mounted, at least one of the forming dies is movable mounted to the die casting machine frame, the link frame subcomponent mounted to the mounting frame subcomponent thereby mounting the burner manifold and link assembly to the die casting machine frame.

11. The preheat burner assembly of claim 10 wherein the link frame subcomponent is rotatably connected to the mounting frame subcomponent along a vertical axis.

12. The preheat burner assembly of claim 11 wherein the mounting frame subcomponent includes:

a lower arm and an upper arm, the lower arm and upper arm spaced apart from one another and each extending orthogonally from a structural post of the die casting machine frame in a first direction;

a vertical member connected to and extending between distal ends of the lower and upper arms; and a protective cover extending vertically between the lower and upper arms and extending horizontally between the vertical member and mounting ends of the lower and upper arms.

13. The preheat burner assembly of claim 12 wherein the link frame subcomponent includes:

a vertical member;

lower and upper arm members spaced apart from one another and each extending orthogonally from the vertical member; and a track spaced apart from the vertical member and extending between the lower and upper arm members for slidably connecting to the link assembly.

14. The preheat burner assembly of claim 13 wherein the link frame subcomponent includes:

a protective door extending orthogonally from the vertical member and orthogonal relative to the lower and upper arms of the link frame subcomponent, the protective door pivotally mounted to the vertical member of the mounting frame subcomponent.

15. The preheat burner assembly of claim 14 wherein the link frame subcomponent is a first link frame subcomponent and the mounting frame subcomponent is a first mounting frame subcomponent, the preheat burner assembly further including:

a second link frame subcomponent having a mirrored orientation relative to the first link frame subcomponent; and a second mounting frame subcomponent having a mirrored orientation relative to the first mounting frame subcomponent, wherein the protective doors of the first and second link frame subcomponents together form a barrier when closed extending from the respective vertical members of the first and second mounting frame subcomponents.

16. A preheat burner assembly, comprising:

a mounting frame for attaching to a die casting machine frame; and a link assembly movably mounting a burner to the mounting frame, the link assembly movable between a stowed position wherein the burner is retracted from a forming die and a deployed position wherein the burner is extended adjacent the forming die for heating thereof, the link assembly includes a first arm having a first end pivotally connected to the mounting frame and a second end pivotally connected to the burner, and a second arm having a first end pivotally and slidably connected to the mounting frame and a second end pivotally connected to the burner.

17. The preheat burner assembly of claim 16 further including an actuator for powered moving of the burner between the deployed and stowed positions.

18. A preheat burner method, comprising:

providing a frame, a burner manifold for preheating forming dies and a link assembly movably mounting the burner manifold to the frame, the link assembly includes a first arm having a first end pivotally connected to the frame and a second end pivotally connected to the burner manifold, and a second arm having a first end pivotally and slidably connected to the frame and a second end pivotally connected to the burner manifold;

moving the burner manifold via the link assembly to a deployed position for preheating the forming dies;

preheating the forming dies; and moving the burner manifold via the link assembly from the deployed position to an upright stowed position.

19. The preheat burner method of claim 18 wherein moving the burner manifold via the link assembly includes using a powered actuator.

* * * * *